US007926747B2

(12) United States Patent
Jameel et al.

(10) Patent No.: US 7,926,747 B2
(45) Date of Patent: Apr. 19, 2011

(54) VARIABLE ORIFICE BLACK LIQUOR NOZZLE

(75) Inventors: Mohomed Ishaq Jameel, Beaverton, OR (US); Daniel R. Higgins, Tigard, OR (US)

(73) Assignee: Clyde Bergemann, Inc., Beaverton, OR (US)

( * ) Notice: Subject to any disclaimer, the term of this patent is extended or adjusted under 35 U.S.C. 154(b) by 0 days.

(21) Appl. No.: 11/766,030

(22) Filed: Jun. 20, 2007

(65) Prior Publication Data

US 2008/0006725 A1 Jan. 10, 2008

Related U.S. Application Data

(60) Provisional application No. 60/805,460, filed on Jun. 21, 2006.

(51) Int. Cl.
*B05B 1/00* (2006.01)
*F23G 7/04* (2006.01)

(52) U.S. Cl. ..... 239/596; 239/390; 239/600; 239/601; 110/238

(58) Field of Classification Search ..... 239/390, 239/391, 397, 397.5, 596, 597, 600, 601, 239/396, 436, 533.14, DIG. 13; 110/238; 175/340

See application file for complete search history.

(56) References Cited

U.S. PATENT DOCUMENTS

| | | | | |
|---|---|---|---|---|
| 2,161,111 | A | 5/1935 | Wilcoxson et al. | |
| 4,128,206 | A | 12/1978 | Bintner | |
| 4,416,422 | A | 11/1983 | Tinnis | |
| 4,793,426 | A * | 12/1988 | Millsapps, Jr. | 175/340 |
| 4,878,548 | A * | 11/1989 | Ostertag et al. | 175/340 |
| 5,247,790 | A | 9/1993 | Donlan et al. | |
| 5,511,725 | A | 4/1996 | Barker et al. | |
| 6,227,316 | B1 * | 5/2001 | Rohde | 175/340 |
| 6,478,235 | B1 | 11/2002 | Soderstrom et al. | |
| 6,578,529 | B2 | 6/2003 | Hytonen et al. | |

FOREIGN PATENT DOCUMENTS

GB 469059 7/1937

* cited by examiner

*Primary Examiner* — Darren W Gorman
(74) *Attorney, Agent, or Firm* — patenttm.us

(57) ABSTRACT

A nozzle for the spraying of black liquor in a recovery boiler has discharge orifice inserts that can be removed and replaced with other inserts, to provide variable spray patterns, by changing the size and/or shape of the orifice of the nozzle, without requiring replacement of the entire nozzle body, to enable fine tuning of the atomization of the spray.

13 Claims, 4 Drawing Sheets

30

FIGURE 4
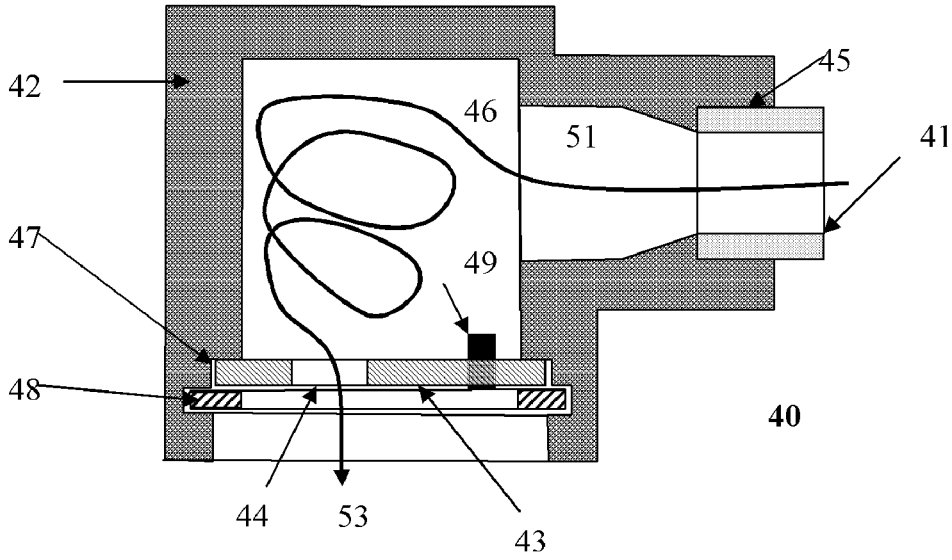
FIGURE 5A
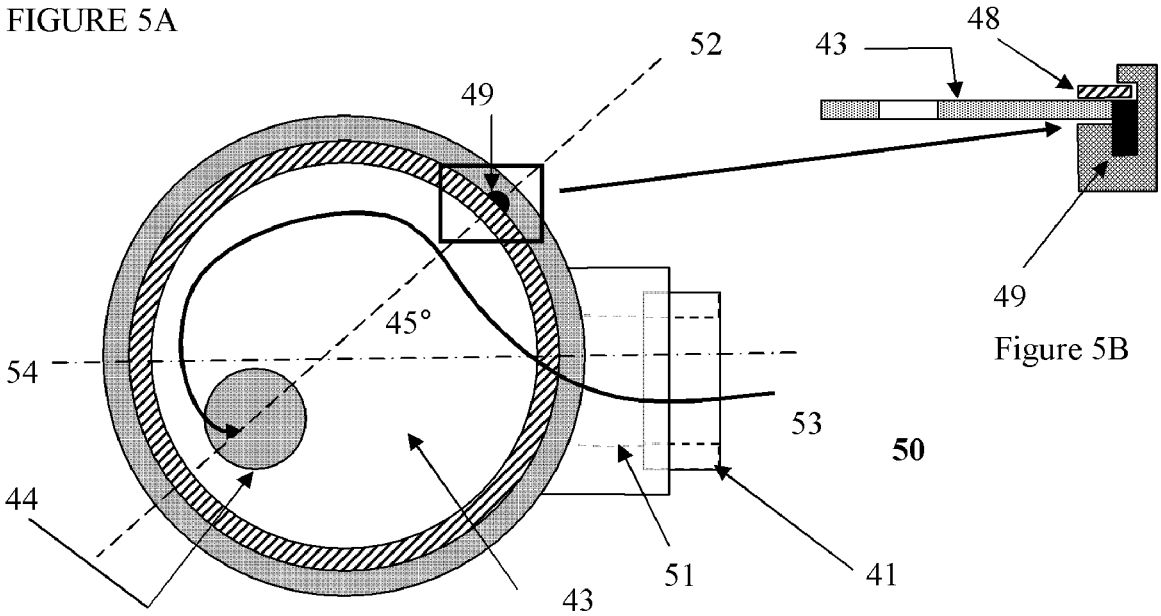
Figure 5B

VARIABLE ORIFICE BLACK LIQUOR NOZZLE

FIELD OF INVENTION

The present invention relates to nozzles used for the injection and atomization of black liquor that is combusted in a chemical recovery boiler.

BACKGROUND OF THE INVENTION

Black liquor is a fluid that is the by product of the pulping process. This fluid contains both organic and inorganic material resulting from the pulping of wood. Black Liquor is burnt in a special boiler where the heat from the organic matter is used to generate steam and the inorganic matter is reduced to extract the pulping chemicals which are then returned to the pulping process. In order to ensure the proper combustion and chemical recovery the liquor has to be atomized to an optimum size. This depends on the boiler geometry as well as operating parameters such combustion air flow, liquor flow rate, injection pressure and temperature.

In accordance with the prior art, black liquor is sprayed into the boiler through dedicated nozzles. FIG. 1 is a schematic of the most widely used nozzle, the splash plate 10. Other nozzles types that have been used are used the V-jet 20 shown in FIG. 2 and more recently the beer can 30 shown in FIG. 3. The latter has come about as a result of new developments in boiler combustion.

In the case of the splash plate nozzle the black liquor is delivered through the pipe 14 which is mounted to the inlet orifice 11 on the nozzle body 13. The fluid leaves the nozzle through the discharge orifice 12. Both the inlet and discharge orifices 11 and 12 are an integral part of the nozzle body 13. The fluid upon leaving the orifice impacts on the splash plate 15 where it spreads out to form a sheet that eventually breaks up into droplets that burn.

For the V-jet nozzle 20 the fluid is delivered through pipe 24 which is mounted to the inlet orifice 21 found on the nozzle body 23. The fluid leaves the nozzle through the discharge orifice 22. Both the inlet and discharge orifices 21 and 22 are an integral part of the nozzle body 23. Fluid traveling through the discharge orifice contracts and spreads out like a fan forming a thin sheet that eventually breaks up into droplets that burn.

For the beer can nozzle 30 the fluid is delivered through pipe 34 which is mounted to the inlet orifice 31 found on the nozzle body 33. The fluid leaves the nozzle through the discharge orifice 32. Both the inlet and discharge orifices 31 and 32 are an integral part of the nozzle body 33. Fluid traveling through the inlet orifice 31 travels down a small transition channel 35 and enters the inner cavity 36 of the nozzle body 33 at a point tangential to the cavity wall. The fluid swirls around the cavity and eventually leaves the nozzle body 33 through the discharge orifice 32 found at the bottom of the nozzle body. The fluid leaving the discharge orifice spreads like a cone which eventually breaks up into droplets that burn.

SUMMARY OF THE INVENTION

In accordance with the invention, a nozzle for the spraying of black liquor in a recovery boiler is provided, where the discharge orifice of the nozzle can easily be varied without having to change the entire nozzle. This enables one to fine tune the atomization to the specific combustion setup at that time and place.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 4: Cross section of variable orifice beer can.

FIG. 5A: Bottom view of the discharge end of the variable orifice beer can.

FIG. 5B: Detail view of roll pin and orifice disk from FIG. 5A.

DETAILED DESCRIPTION

Figure 1:
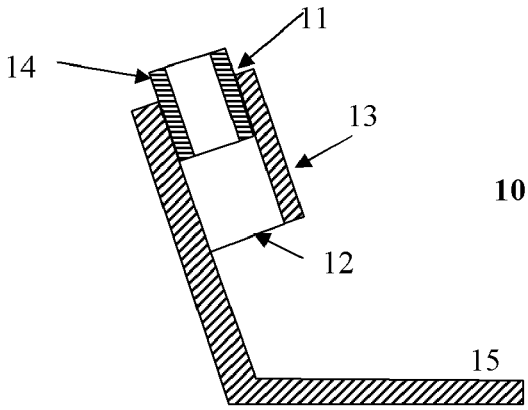
Figure 1 Prior Art
FIG. 1: Cross section of prior art splash plate nozzle.
Figure 2:
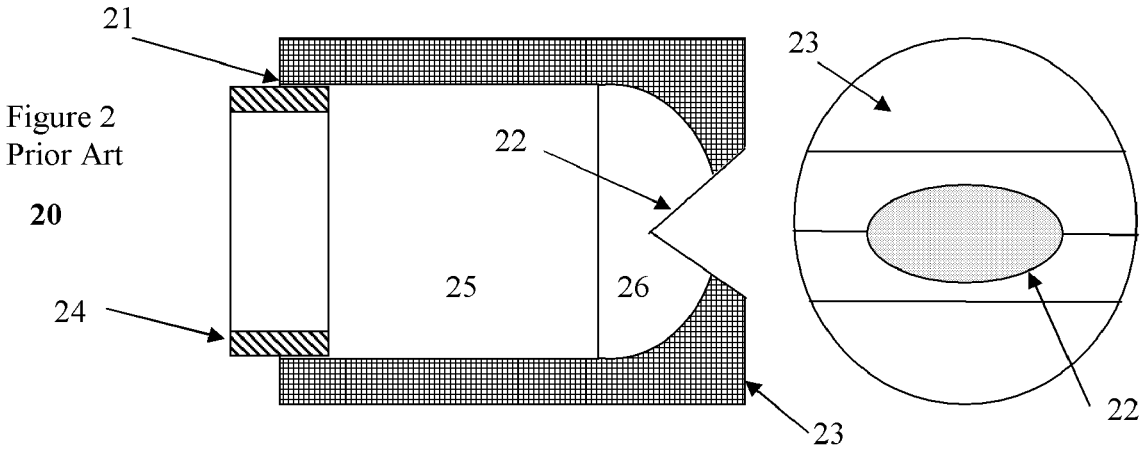
Figure 2 Prior Art
FIG. 2: Cross section of prior art V-jet nozzle.

In order to optimize the combustion and chemical reduction it may be necessary for one to change the orifice size to vary the injection pressure or vary the flow rate. For all of the prior art nozzles above, the discharge orifice is an integral part of the nozzle body which would therefore require one to change the entire nozzle body in order to change the orifice. In another instance it may be necessary to change the orifice due to wear which results in the increase in flow area and/or change in shape. With the nozzle arrangement in accordance with the invention disclosed here one has to only change a single piece that bears the opening for the discharge orifice in order to change the orifice size.

FIGS. 4 & 5 show the arrangement of a beer can type nozzle 40 in accordance with this invention. FIG. 4 shows the cross section through the nozzle while FIG. 5A shows a view of the bottom end of the nozzle 50 with the details for the variable orifice. FIG. 5B gives a more details view of a section of the arrangement in FIG. 5A. In the case of the beer can nozzle 40 the fluid is delivered through a pipe 41 which is mounted to the inlet orifice 45 found on the nozzle body 42. According to FIG. 5A the fluid entering through 41 travels through the passage 51 and enters the body at the top of the inner cavity 46 of the nozzle while traveling tangent to its wall. The fluid swirls around the inner cavity as illustrated by the path 53 and is finally ejected through the orifice the orifice 44. The orifice is made by drilling a hole on the orifice disk 43.

Figure 3:
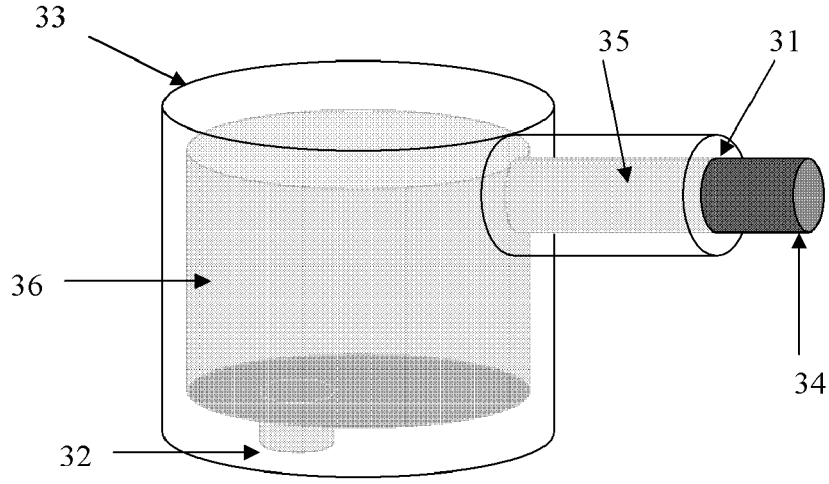
Figure 3 Prior Art
FIG. 3: Schematic of prior art beer can nozzle.
Figure 8:
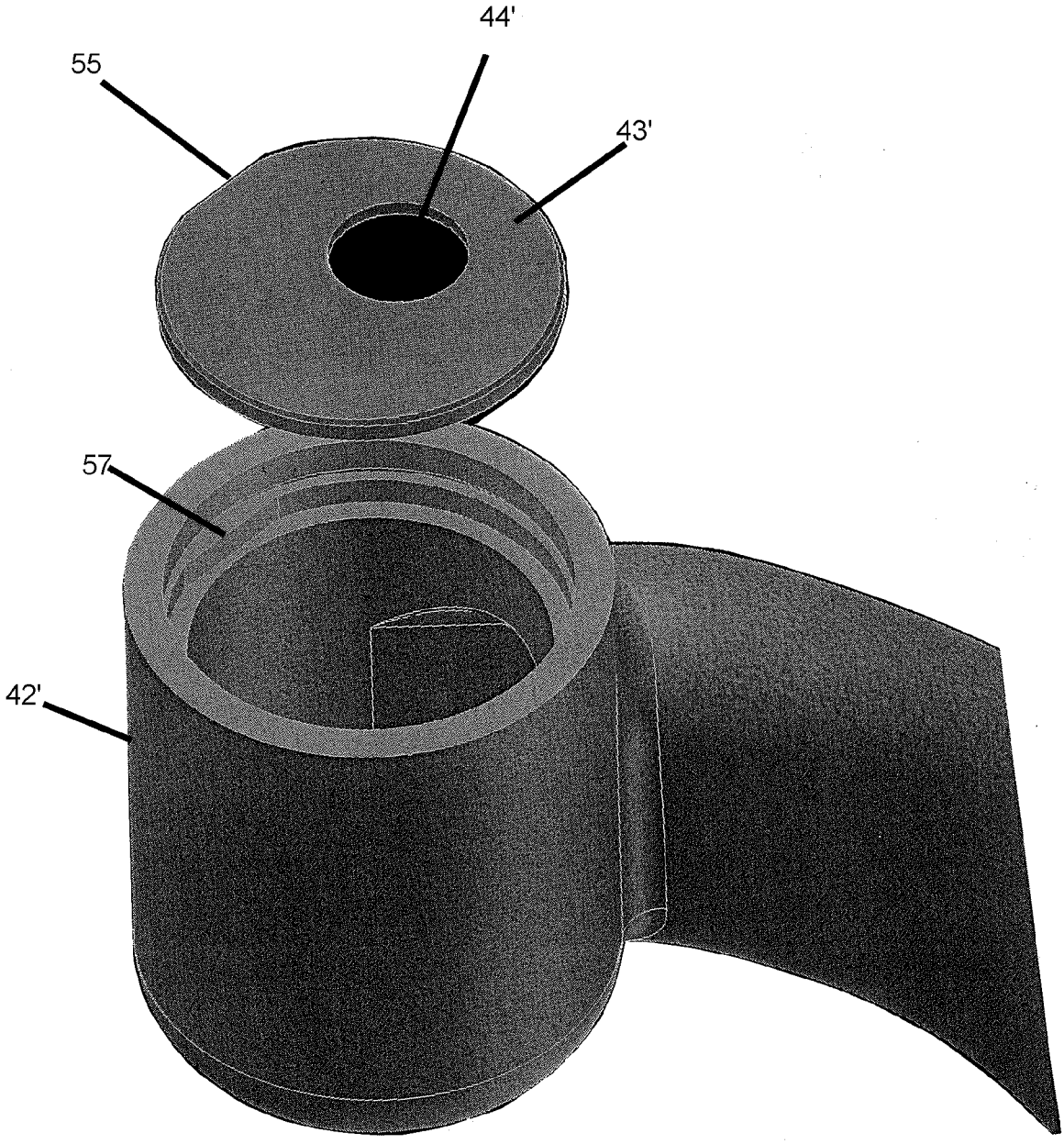
FIG. 8: Exploded perspective view of variable orifice beer can employing alternative Another variation for the V-jet nozzle.

Unlike the prior art 30 in FIG. 3, this disk is not an integral part of the nozzle body 42. It is a totally independent component which is placed in a recess at the exit end of the nozzle. When the nozzle is in use the orifice disk faces down. A snap ring 48 prevents it from falling out of the nozzle body. In order to achieve the swirling flow inside the nozzle the discharge orifice should lie rotationally in the quadrant furthest away from the inlet orifice. In order to maintain this position the orifice plate is held securely by pin 49 that has part of its circumference engaged with disk 43 while the remainder engaged with the housing 42. In liu of the pin a flat face 55 could be cut on the perimeter of the disk 43', as illustrated in FIG. 8, a perspective view of an alternative beer can type nozzle body 42' and discharge disk. A corresponding flat face 57 would be cut in the nozzle body 42' as well. In either case, the pin or flat face and the orifice hole are set 180° apart and the lie along the line 52 which is at an angle of 45° from the center line 54 of the inlet orifice. The pin is inserted into a hole in the housing. The depth of the hole is selected such that the pin does not protrude beyond the surface of the disk. It is important to have the pin flush with the outer surface of the disk in order to properly seat the snap ring. While it is possible to hold the disk by cutting a male thread on the edge of the disk corrosion and thread distortion due to heat does not make it very practical. In order to enable one to operate the nozzle in the environment of a chemical recovery boiler while maintaining the ability to change the orifice diameter by swapping out the orifice disk the nozzle housing are made of different materials which have substantially different thermal expansion coefficients. The thermal expansion coefficient of the disk is greater than that of the nozzle housing. The disk diameter and the recess diameter in the nozzle body are carefully controlled so that at room temperature (~20° C.) a specific gap 47 is maintained between the two of them. The black liquor delivered to the nozzle is in the range of 100-130° C. Therefore at elevated temperatures the disk would expand more than the housing hence closing the gap 47 ensuring a seal of the inner chamber 46. When the nozzle is taken out of service and the temperature lowered to room temperature the disk will shrink to its original size which in turn will enlarge the clearance between these two components enabling one to swap out the disk thereby changing the orifice diameter.

Figure 6A:
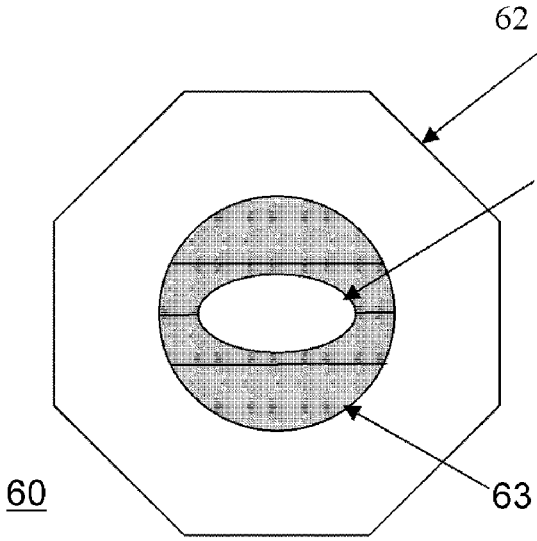
FIGS. 6A and 6B: Front and cross section of the variable orifice V-jet.
Figure 6B:
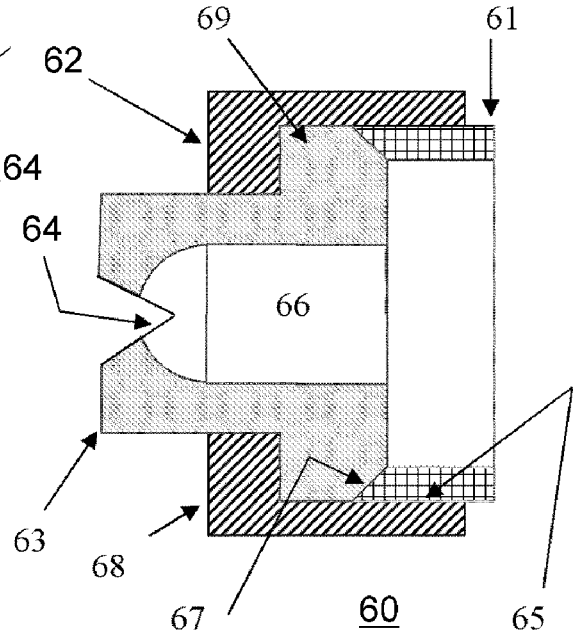

FIGS. 6A and 6B show a V-jet nozzle 60 fitted in a manner according to this invention. Fluid enters the nozzle through pipe 61 which is mounted to the inlet orifice 65 on body 62. Sandwiched in between the pipe 61 and the nozzle body 62 is the orifice insert 63. Fluid passes from the pipe into the inner cavity 66 and is then ejected through the discharge orifice 64. The insert has a shoulder 69 which butts up against the shoulder 68 located at the end opposite inlet orifice. In order to keep the specific orientation of the spray from a V-jet insert 63 is free to rotate in side the nozzle body. Once the orientation of the orifice 64 has been finalized the nozzle body is tightened up against the pipe through matching threads on the pipe and nozzle body. A sloped interface 67 between the orifice insert and the pipe ensures the fluid does not leak out of the nozzle body.

Figure 7:
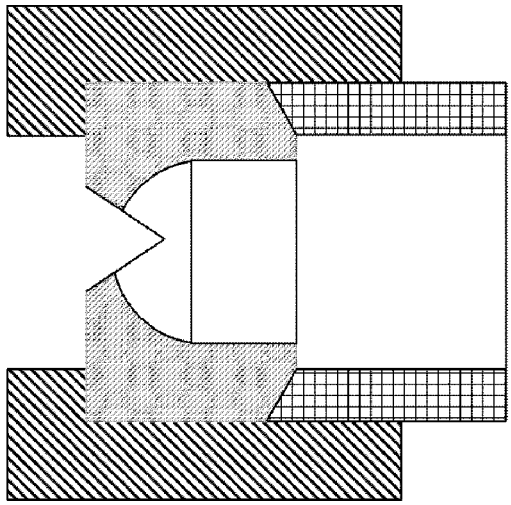
FIG. 7: Another variation for the V-jet nozzle.

FIG. 7 illustrates another variation of the V-jet nozzle.

Thus, in accordance with the invention, a nozzle arrangement is provided to enable changing of orifice properties to adjust flow and spray pattern without requiring the replacement of the entire nozzle body. This can provide lower cost operation and maintenance, for example. Further, the orifice properties may be changed to provide desired drop sizes and droplet velocities in the spray for optimum combustion in the recovery boiler.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A nozzle for spraying black liquor in a recovery boiler capable of operating with multiple orifice sizes and shapes while using the same nozzle body, comprising:

a nozzle body, an inlet orifice, a removable discharge orifice insert having an orifice defined therein, wherein said nozzle body includes a discharge orifice fixing mechanism for securing said discharge orifice in position relative to the nozzle body, said fixing mechanism comprising a pin having a circumference partially engaged with a perimeter of said discharge orifice insert and partially engaged with said nozzle body, wherein said pin and said discharge orifice are set 180° apart, and wherein said pin and said discharge orifice lie along a line which is at an angle of 45° from a center line of the inlet orifice.

2. A nozzle for spraying black liquor in a recovery boiler capable of operating with multiple orifice sizes and shapes while using the same nozzle body, comprising:

a nozzle body having an inlet orifice and an outlet, a removable discharge orifice insert having an orifice defined therein, wherein said nozzle body includes a discharge orifice fixing mechanism for securing said discharge orifice in position relative to the nozzle body, said fixing mechanism comprising a geometric feature on a perimeter of said discharge orifice insert and a corresponding engaging feature defined in said nozzle body, wherein said geometric feature and said discharge orifice are set 180° apart, and wherein said geometric feature and said discharge orifice lie along a line which is at an angle of 45° from a center line of the inlet orifice.

3. A nozzle for spraying black liquor in a recovery boiler capable of operating with multiple orifice sizes and shapes while using the same nozzle body, comprising:

a nozzle body having an inlet orifice and an outlet, a removable discharge orifice insert having an orifice defined therein, wherein said nozzle body includes a discharge orifice fixing mechanism for securing said discharge orifice in position relative to the nozzle body, said fixing mechanism comprising a geometric feature on a perimeter of said discharge orifice insert and a corresponding engaging feature defined in said nozzle body wherein said removable discharge orifice insert is disk shaped and said geometric feature comprises a flat portion defined along a portion of the perimeter of said removable discharge orifice insert and said corresponding engaging feature comprises a corresponding flat face portion defined in said nozzle body for cooperative engagement between said flat portion defined on said removable discharge orifice insert and said flat face portion defined in said nozzle body, wherein said flat portion defined along a portion of the perimeter of said removable discharge orifice insert and said discharge orifice are set 180° apart, and wherein said flat portion defined along a portion of the perimeter of said removable discharge orifice insert and said discharge orifice lie along a line which is at an angle of 45° from a center line of the inlet orifice.

4. A nozzle for spraying black liquor in a recovery boiler capable of operating with multiple orifice sizes and shapes while using the same nozzle body, comprising:

a nozzle body, an inlet orifice, a removable discharge orifice insert having a discharge orifice defined therein, said discharge orifice immediately discharging to the atmosphere outside said nozzle body, wherein said nozzle body includes a discharge orifice fixing mechanism for securing said discharge orifice in a position that lies along a line which is at an offset angle from a center line of the inlet orifice, and wherein said fixing mechanism comprises a pin having a circumference partially engaged with a perimeter of said discharge orifice insert and partially engaged with said nozzle body.

5. The nozzle according to claim 4, wherein said orifice in said removable discharge orifice insert defines an opening to provide a desired spray pattern of a substance sprayed through said nozzle.

6. The nozzle according to claim 4, wherein said pin and said discharge orifice are set 180° apart.

7. A nozzle for spraying black liquor in a recovery boiler capable of operating with multiple orifice sizes and shapes while using the same nozzle body, comprising:

a nozzle body, an inlet orifice, a removable discharge orifice insert having a discharge orifice defined therein, said discharge orifice immediately discharging to the atmosphere outside said nozzle body, wherein said nozzle body includes a discharge orifice fixing mechanism for securing said discharge orifice in a position that lies along a line which is at an offset angle from a center line of the inlet orifice, and wherein said fixing mechanism comprises a geometric feature of said nozzle body and a corresponding geometric feature on said removable discharge orifice insert, for defining interacting features that fix the position of said discharge orifice insert in relation to said nozzle body.

8. The nozzle according to claim 7, wherein said removable discharge orifice insert is disk shaped and said geometric feature comprises a flat portion defined along a portion of the perimeter of said removable discharge orifice insert and said corresponding engaging feature comprises a corresponding flat face portion defined in said nozzle body for cooperative engagement between said flat portion defined on said removable discharge orifice insert and said flat face portion defined in said nozzle body.

9. The nozzle according to claim 8, wherein said flat portion defined along a portion of the perimeter of said removable discharge orifice insert and said discharge orifice are set 180° apart.

10. The nozzle according to claim 7, wherein said orifice in said removable discharge orifice insert defines an opening to provide a desired spray pattern of a substance sprayed through said nozzle.

11. The nozzle according to claim 7, wherein said fixing mechanism further comprises a snap ring member positioned adjacent an outlet face of said removable discharge orifice insert and between said outlet face and a discharge opening of said nozzle body.

12. The nozzle for spraying black liquor according to claim 11, wherein said snap ring member is immediately adjacent said outlet face.

13. A nozzle for spraying black liquor in a recovery boiler capable of operating with multiple orifice sizes and shapes while using the same nozzle body, comprising:

a nozzle body, an inlet orifice, a removable discharge orifice insert having a discharge orifice defined therein, said discharge orifice immediately discharging to the atmosphere outside said nozzle body, wherein said nozzle body includes a discharge orifice fixing mechanism for securing said discharge orifice in a position that lies along a line which is at an offset angle from a center line of the inlet orifice, and wherein said offset angle comprises 45 degrees.

* * * * *